United States Patent [19]

Leckie

[11] Patent Number: 4,477,933

[45] Date of Patent: Oct. 23, 1984

[54] TOILET SEAT CLOSURE

[76] Inventor: Franklin J. Leckie, 110 Parkdale Dr., Greenville, S.C. 29611

[21] Appl. No.: 497,054

[22] Filed: May 23, 1983

[51] Int. Cl.[3] ..... A47K 13/00

[52] U.S. Cl. ..... 4/253; 4/251; 4/661

[58] Field of Search ..... 4/248, 251, 253, 234, 4/661, 236; 16/71–76, 85, 278, 279, 286, 304; D8/402

[56] References Cited

U.S. PATENT DOCUMENTS

| | | | |
|---|---|---|---|
| 921,556 | 5/1909 | Moran | 16/85 |
| 1,856,159 | 5/1932 | Grillo et al. | 4/251 |
| 2,477,378 | 7/1949 | Jurinak | 4/248 |
| 4,314,382 | 2/1982 | Ginsburg et al. | 4/236 |

*Primary Examiner*—Stephen Marcus
*Assistant Examiner*—Kenneth S. Putnam
*Attorney, Agent, or Firm*—Julian W. Dority

[57] ABSTRACT

A coil spring device for mounting on a water tank of a toilet for ensuring that a toilet seat remains closed when not in use.

3 Claims, 2 Drawing Figures

TOILET SEAT CLOSURE

BACKGROUND OF THE INVENTION

On most modern-day toilets, there is mounted a seat which rests on the rim of the toilet bowl that has a cover pivotally attached thereto. The cover can be raised and lowered for providing use of the toilet. When the cover is left in a raised position, objects can be inadvertently dropped into the toilet. The toilet also becomes a safety hazard with regard to infants. Infants have a natural tendency to play in the water carried in the toilet, and if the infant crawls over the top of the rim of the toilet, he is subject to drowning.

Automatic seat lids for toilets are known, and one such device is described in U.S. Pat. No. 4,195,372. This device includes a seat spring which ensures that the seat is returned to the down position wherein it rests on the rim of the toilet when not being used. This is to eliminate the possibility of inadvertently sitting on the toilet rim instead of the seat.

However, such device does not ensure that the cover which normally extends over the seat also remains in the closed position when not in use.

SUMMARY OF THE INVENTION

This invention relates to a device for ensuring that the cover extending over a seat of a toilet is in a lowered position relative to the seat when the toilet is not being used. It is adapted to be placed on a conventional toilet that has a bowl with a water tank hung adjacent to the lid portion thereof. Normally, the tank has a front vertically extending wall with a tank cover extending thereover. A hinged connection secures the toilet set cover the rim of the bowl permitting the cover to be pivoted thereabout for raising and lowering the cover.

A coil spring extends forward from the front wall of the water tank for contacting the cover prior to the cover reaching a straightup vertically extending position so that the cover must be manually held in the raised position. When the cover is released, the coil spring ensures that it cannot remain in the raised position and is returned manually back down to the lowered closed position.

Accordingly, it is an important object of the present invention to provide a device for ensuring that a toilet seat cover remains closed when not in use.

Another important object of the present invention is to provide a simple and inexpensive device which ensures that a toilet seat cover remains closed when not in use.

The constructed designed to carry out the invention will be hereinafter described, together with other features thereof.

These and other objects and advantages will be more fully understood from a reading of the following specification and claims and by reference to the accompanying drawing forming a part thereof, wherein an example of the invention is shown and wherein:

DESCRIPTION OF A PREFERRED EMBODIMENT

Figure 1:
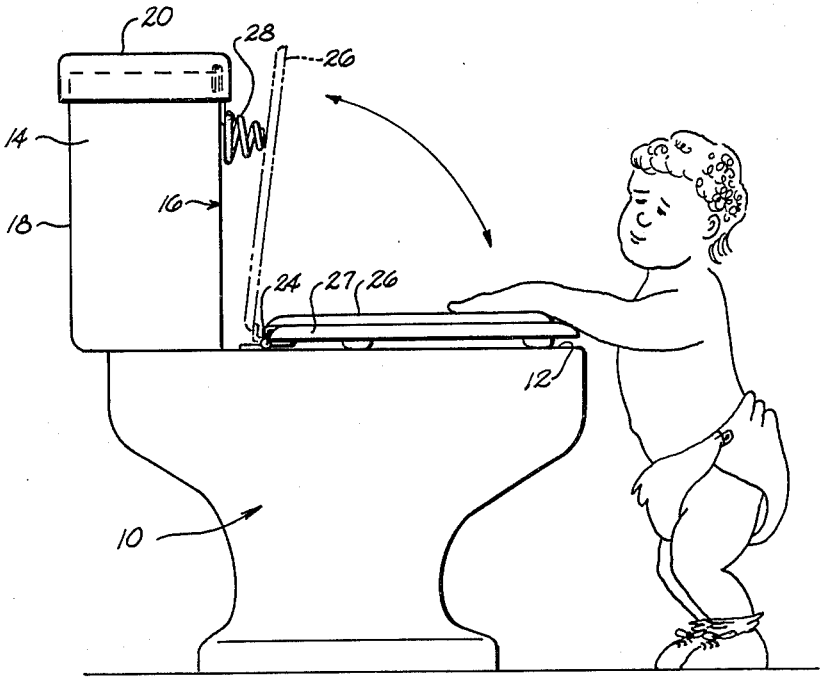
FIG. 1 is a side elevational view illustrating a conventional toilet equipped with a seat closure device constructed in accordance with the present invention.

Referring in more detail to the drawing, there is illustrated a conventional toilet having a conventional bowl 10 having a rim 12 extending therearound. Positioned adjacent the rear portion of the bowl is a water tank 14 which carries the water used for flushing the toilet. The tank includes a vertically extending front wall 16 and rear wall 18 joined by side walls. A cover 20 extends over the top of the tank.

A toilet seat 22 is connected by means of hinges 24 to the rim 12 of the bowl. Also connected to the hinge 24 is toilet set cover 26. In normal use, when the toilet seat cover 26 is raised, it rests upon the front wall 16 of the tank 14. When in this position, the interior of the toilet bowl is accessible to infants and also objects that fall therein.

In order to ensure that the toilet seat cover 26 remains in the closed position as shown in full lines in FIG. 1, a coil spring 28 is carried adjacent to the front wall of the water tank so as to contact the seat 26 prior to its reaching the straightup vertical position when raised. Such permits the spring 28 to be compressed when the toilet is being used, however, upon manually releasing the seat 26, it is returned to its lower closed position. The diameter of the coil spring 28 goes progressively from a large diameter adjacent one end to a small diameter portion adjacent the other end. In normal operation, the smaller diameter end engages the toilet seat cover and the large diameter portion would rest against the front wall 16 of the tank 14.

Figure 2:
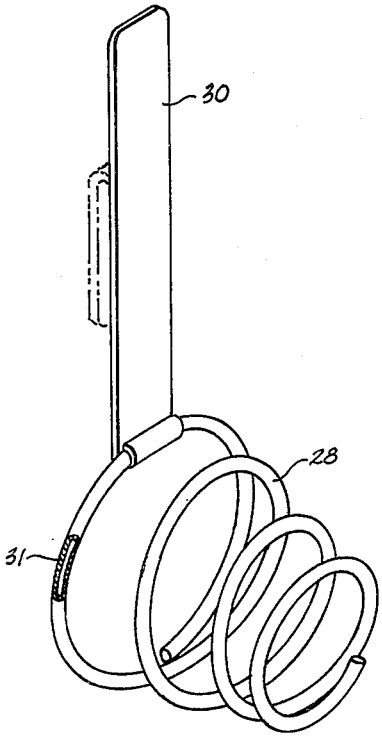
FIG. 2 is a perspective view of the closure device of FIG. 1.

In order to readily mount the coil spring 28, a flexible tab 30 is used. One end of the flexible tab 30 is attached to the large diameter end of the coil spring by bending it around the large diameter portion of the coil. The other end can be readily attached to the water tank by folding such back over the top of the water tank as shown in FIG. 1 and in phantom lines in FIG. 2. After the upper end of the tab 30 is folded over the top of the front wall of the tank, the cover is placed back over the tank to secure such in position. In order to prevent corrosion, the tab 30 is normally constructed of thin bendable galvanized sheetmetal, and the coil spring which is constructed of metal, is coated with any suitable plastic coating 31.

While a preferred embodiment of the invention has been described using specific terms, such description is for illustrative purposes only, and it is to be understood that changes and variations may be made without departing from the spirit or scope of the following claims.

What is claimed is:

1. A device for ensuring that a toilet seat cover extending over a seat of a toilet is in a lowered or closed position relative to the seat when said toilet is not being used comprising:

said toilet including, (i) a bowl;

(ii) a water tank carried adjacent a rear potion of said bowl, said tank having a front vertically extending wall with a tank cover extending thereover;

(iii) said seat being carried on said bowl;

(iv) a hinge connection securing said toilet seat cover to a rear portion of said bowl permitting said cover to be pivoted thereabout for raising and lowering said cover;

a coiled spring extending forwardly from said water tank for contacting said cover prior to said cover reaching a straight-up vertically extending position so that said cover must be manually held in the raised position; and means for hanging said coiled spring on said water tank.

2. The device as set forth in claim 1 further comprising:

said means for hanging said coiled spring on said water tank including an elongated tab having one end connected to said coiled spring and the other end extending over said front wall of said water tank so as to support said coiled spring for contacting said seat when raised.

3. The device as set forth in claim 2 further comprising:

said coiled spring progressively going from a large diameter adjacent one end to a smaller diameter adjacent the other end; and said large diameter end pressing against said front wall of said water tank.

* * * * *